US007131464B2

(12) United States Patent
Upton

(10) Patent No.: US 7,131,464 B2
(45) Date of Patent: Nov. 7, 2006

(54) APPARATUS TO FACILITATE WEAVING AROUND A CYLINDRICAL OBJECT

(75) Inventor: James Upton, Huntington Beach, CA (US)

(73) Assignee: Renzetti, Inc., Titusville, FL (US)

( * ) Notice: Subject to any disclaimer, the term of this patent is extended or adjusted under 35 U.S.C. 154(b) by 77 days.

(21) Appl. No.: 10/912,251

(22) Filed: Aug. 5, 2004

(65) Prior Publication Data

US 2005/0092385 A1 May 5, 2005

Related U.S. Application Data

(60) Provisional application No. 60/493,410, filed on Aug. 6, 2003.

(51) Int. Cl.
*D03D 49/02* (2006.01)

(52) U.S. Cl. ..... 139/1 R

(58) Field of Classification Search ..... 139/457, 139/16, 14, 11, 1 R, 29; 87/34; 43/18.1 R
See application file for complete search history.

(56) References Cited

U.S. PATENT DOCUMENTS 194,741 A * 8/1877 Stowe ..... 139/457
1,399,904 A * 12/1921 Terrell ..... 139/14
3,459,621 A * 8/1969 Vladimir et al. ..... 156/393
3,709,262 A * 1/1973 Braunschweiler ..... 139/14

* cited by examiner

*Primary Examiner*—John J. Calvert
*Assistant Examiner*—Andrew W. Sutton
(74) *Attorney, Agent, or Firm*—Eugene E. Renz, Jr.

(57) ABSTRACT

An apparatus for weaving patterns comprising pattern threads and wrapping threads around an object having a central axis comprising an elongated slide tube and at least two side wheel assemblies, one of said side wheel assemblies mounted on said slide tube and the other of said side wheel assembly mounted on said object and spaced axially therefrom a distance greater than the axial extent of the pattern to be weaved; each of said side wheel assemblies having a thread wheel with a series of radially directed circumferentially spaced slots and a number ring having number indicia means which are axially aligned relative to one another and which correspond to pattern thread lines on a chart for a pattern; means for securing the pattern threads at one end to said object and engaging each of the threads in a numbered slot in one of the side wheel assemblies which may be selectively withdrawn from the slot in said one side wheel assembly and inserted into a corresponding number in said other side wheel assembly during the weaving process.

5 Claims, 18 Drawing Sheets

APPARATUS TO FACILITATE WEAVING AROUND A CYLINDRICAL OBJECT

This application claims the benefit of Provisional Patent Application filed Aug. 6, 2003, Ser. No.: 60/493,410 entitled Apparatus to Facilitate Weaving Around a Cylindrical Object.

FIELD OF THE INVENTION

The present invention relates to method and apparatus for weaving a desired or predetermined pattern on a cylindrical surface such as a fishing rod.

BACKGROUND OF THE INVENTION

It is generally known to weave patterns on a flat pattern and then wrap the generally rectangular woven pattern around the butt end of a fishing rod and secure it in place with an adhesive. This, of course, creates a seam and it has been found that over a period of time and use, the sleeve loosens and is not as esthetically pleasing.

The method and apparatus of the present invention is characterized by novel features of construction and arrangement facilitating weaving around an object such as a cylindrical or tubular surface so that the woven pattern is continuous, seamless, and snugly embraces the periphery of the object such as a fishing rod. The apparatus and method facilitate a continuous seamless weaving and includes means for selective movement of pattern threads during the weaving process without entanglement of threads.

The configuration of the apparatus of the present invention permits making not only a seamless continuous weave around a fishing rod but also the ability to weave individual patterns on any axis of the fishing rod at the same time. For example, a desired pattern such as a fish pattern may be placed on one side of the rod and the rod owner's initials on the other side allowing sufficient peripheral or circumferential rod surface to accommodate both patterns.

Considering the basic components of the apparatus of the present invention, the apparatus comprises an elongated tubular slide tube which may be mounted on the butt end of a fishing rod, a series of side wheel assemblies each including a peripherally slotted thread wheel and number rings. Pattern threads are positioned in the numbered slots of the side wheel assemblies which are related to the thread lines of the pattern. Accordingly, in the weaving process, the pattern threads can be moved from a given numbered slot of one side wheel assembly to a similarly numbered slot in a second side wheel assembly so that the pattern threads can be selectively positioned to be in the path or out of the path of the wrapping or background thread as determined or dictated by the pattern. In the embodiment illustrated, the thread wheel has 180 slots, half of which are numbered thus allowing the user to establish a center for the opposing pattern if one is used without having to renumber the number rings.

The apparatus is user friendly and easily adapts to color weaving and will accommodate many colors. The design keeps threads from hanging and twisting into a tangled mess.

SUMMARY OF THE INVENTION

The apparatus and method of the present invention referred to commercially as the "wonder weaver" is a tool designed to facilitate weaving around a cylindrical object. It was developed to weave on fishing rods or it can be used on any like object that it will fit over. In its current configuration it can be used, not only to make a continuous weave around a fishing rod, but to weave individual patterns on any axis of a rod (space permitting) at the same time. For example, a standard fish pattern may be placed on one side of the rod and the owner's initials on the other side with the only requirement being sufficient circumference to accommodate both patterns.

The wonder weaver is easy to use for color change weaving and will accommodate as many colors as one is capable of handling. Its design keeps threads from hanging and twisting into a tangled mess. The slots holding each thread are clearly identified on both the right and left sides of the weave, making thread identification much easier.

Because all threads are held firmly, no additional precaution is necessary to insure threads are secured during the weaving process.

Setting up the wonder weaver is simple; each thread has a numbered slot to easily identify if the thread count is incorrect or if a slot has been missed. The threads can then be adjusted, added or removed before going any further. The wonder weaver comes with 180 slots designed with only 90 of the slots numbered, allowing the user to establish a "center" for the opposing pattern when one is used, without having to renumber the left if one is used. Weaves should be made prior to putting line guides in place but can be made after the under wraps if they are used.

Setting up the wonder weaver is easy but there are a few things to keep in mind depending on the number of patterns you intend to weave. You do need to plan ahead a little. If you are doing a single weave locate and mark the pattern center line on the rod where you want the weave to be located. This is usually the same center line that you would use to line up your guides with the reel seat on a conventional rod and the opposite side for a spinning or fly rod. Assuming you want the pattern on the "up" side of the rod as it is fished, if you are doing more than one pattern such as a fish on one side and a name of the other locate and mark another center line 180 degrees from your first center line. This will center your patterns as opposite of the rod.

Hold the wonder weaver tube (this is mounted on the rod on the left side of the weave) up to the rod and note the area where the screws will come in contact with the rod. If this area falls on a grip, wrap a piece of cardboard tubing that has been cut down the middle around the rod (a tube from a roll of paper towels or bathroom tissue will do very well) and pull it tight and then tape it in place with masking tape. Do not put masking tape on the grip. The tape may damage some grip materials. Build up four or five layers of tape on the cardboard tube where the screws will tighten down on the rod. Next, wrap two or three layers of masking tape on the rod where the screws on the front end of the tube will touch the rod. If this is also on a grip, repeat the cardboard tube instructions. Do the same for the right side wheel about 14 inches to the right of the where you want the weave to go. Use three or four layers of masking tape to protect the rod blank where the screws will make contact.

Note that the wheels on the wonder weaver are numbered only half way around. This is done to allow numbering for a second pattern, when weaving more than one pattern at a time. If your pattern has more than 90 threads simply continue the numbering until you get to what you need. Before mounting the tube on the rod, remove the wheels and locate the center pattern thread number of the first weave and then note the 180 degree point on the wheel. This will be the center thread on the second pattern. Put in the pattern thread numbers by using a fine point marker pen on the plexiglass or on models with the labels on the plexiglass, by using red and blue ¼" round stick on labels and numbering them. You can clean the plexiglass with alcohol and/or remove the labels when the weave is complete. This keeps you from having to renumber the second pattern or change the left list if you use one.

Note how the numbering is done on the wheels and be sure the numbers you put in get higher in the same direction. The right and left side wheels are mirror images and the numbering will get higher to the right on the right side wheel and higher to the left on the left side wheels with the wheel lying flat on the table in front of you with the numbers facing up.

Reassemble the tube and mount it on the rod with the numbers facing to the right. Align the center pattern thread number with the pattern center line on the rod. Hold the tube so the rod is centered. Tighten the screws until they are just snug enough to keep the tube from moving. The threads will pull on the wheel and with a lot of them you would be surprised at the amount of tension that can be exerted.

Next mount the right side wheel with the numbers facing to the left and the center thread number on the center line. Hold it centered and snug the screws as you did on the tube. Do not over tighten the screws or you could crush the blank.

Check the tube and right side alignment by running a piece of thread in the same number slot from left to right and sight along the thread to see that the slots line up. If they do not, loosen the screws on the right side wheel and adjust it until they do. Then snug the screws again.

The wonder weaver is now ready and you can put your pattern threads on the rod. For color change weaves, put on the color with the highest number of threads first. Use tape reversed on itself at the base (left side) of the weave on the rod so the sticky side is out. Leave enough space between the tape and the start of the weave to allow you to cut the pattern threads to the tape and place the other end in th appropriate slot on the right side wheel. It is often best to start with the middle thread and work in both directions. When all of the threads of that color are in place, do the next being sure that they are located directly over the appropriate thread number.

If you are doing two patterns at the same time, put the threads for the second pattern on in the same manner as you did for the first and at the same time. After you put on the first color for the first weave, rotate the rod and put on the first color for the second weave and soon. Be sure to locate the center thread of the second weave over the center line for that pattern.

Once all the pattern threads are on and the left ends are wrapped down tight, you are ready to start your weave.

DESCRIPTION OF THE DRAWINGS

These and other objects of the present invention and the various features and details of the operation and constructions thereof are hereafter more fully set forth with reference to the accompanying drawings, wherein.

DESCRIPTION OF THE PREFERRED EMBODIMENTS

Figure 1:
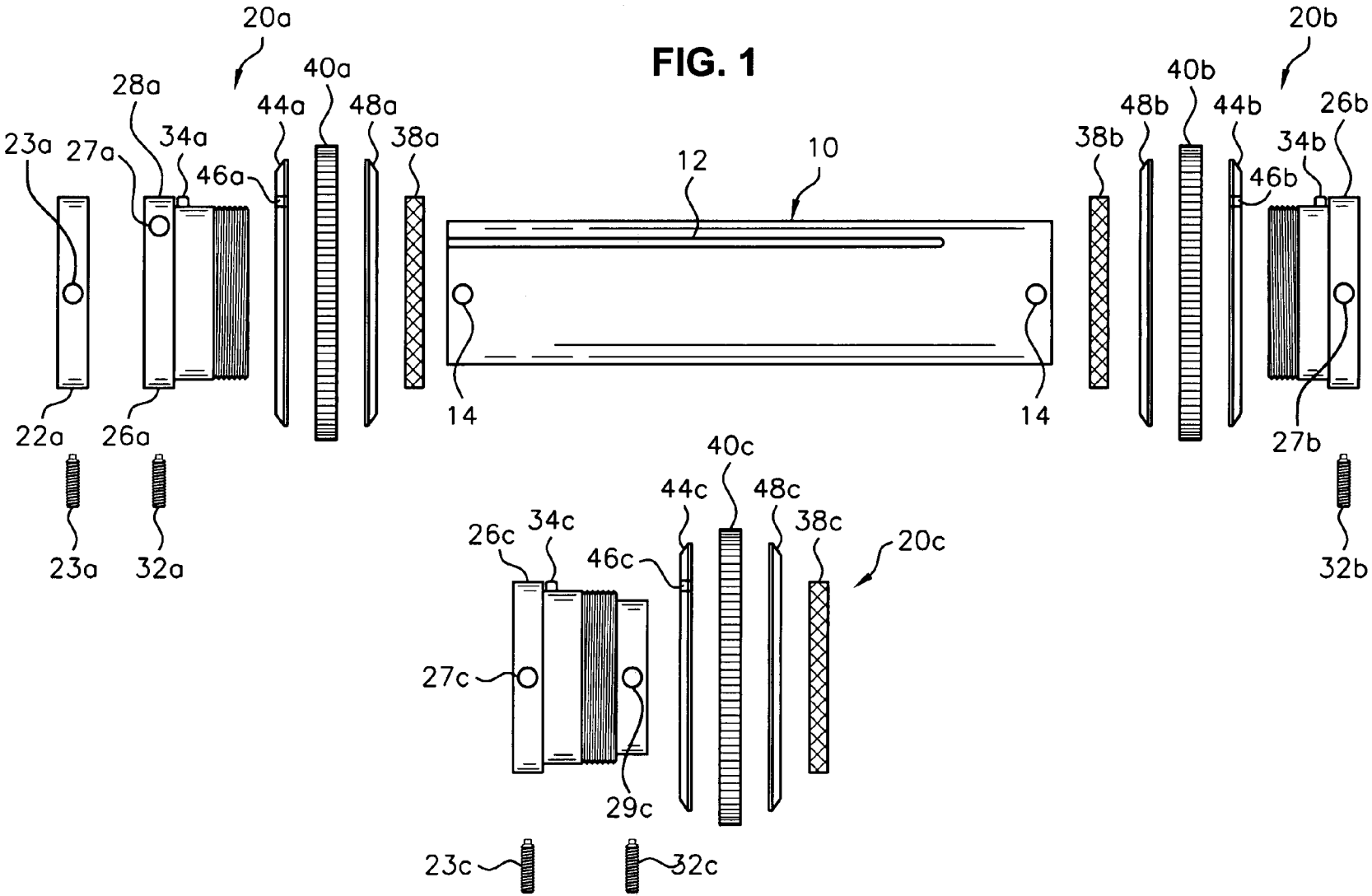
FIG. 1 is an exploded side elevational view of the apparatus for weaving around circular objects such as a fishing rod including the slide tube and the components of the side wheel assemblies.
Figure 2A:
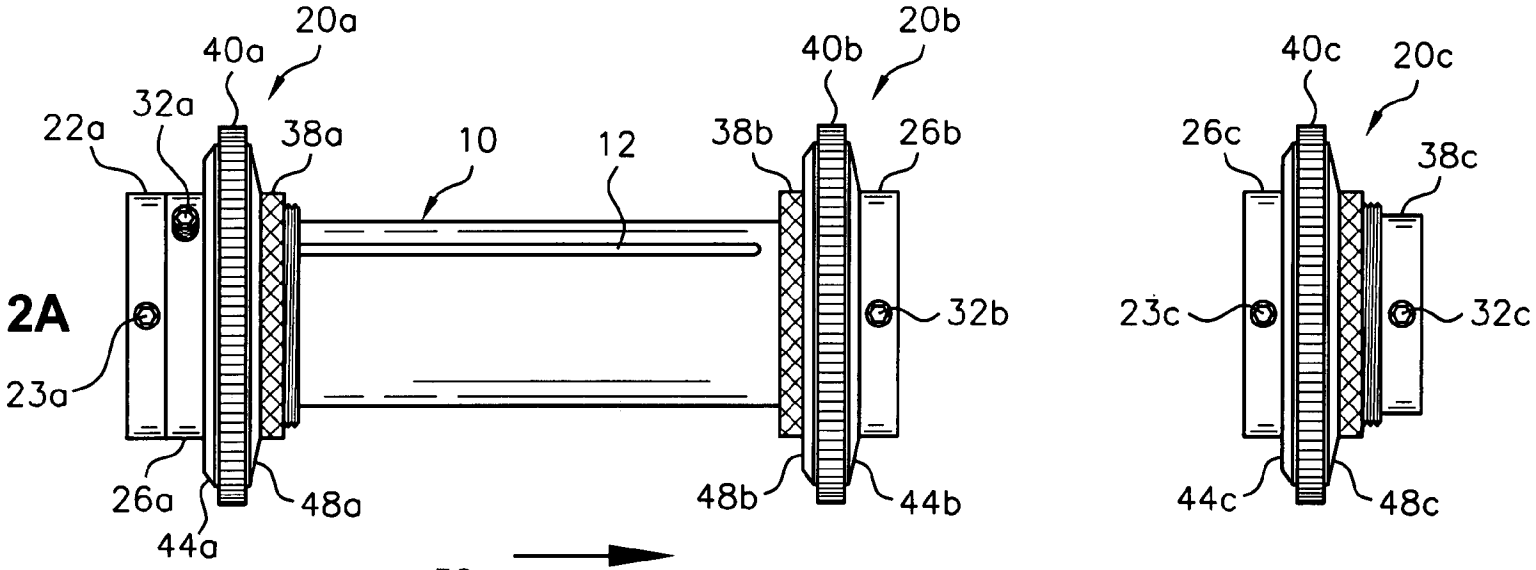
FIG. 2*a* is a side elevational view of the tube and side wheel assemblies in the assembled relation.
Figure 2B:
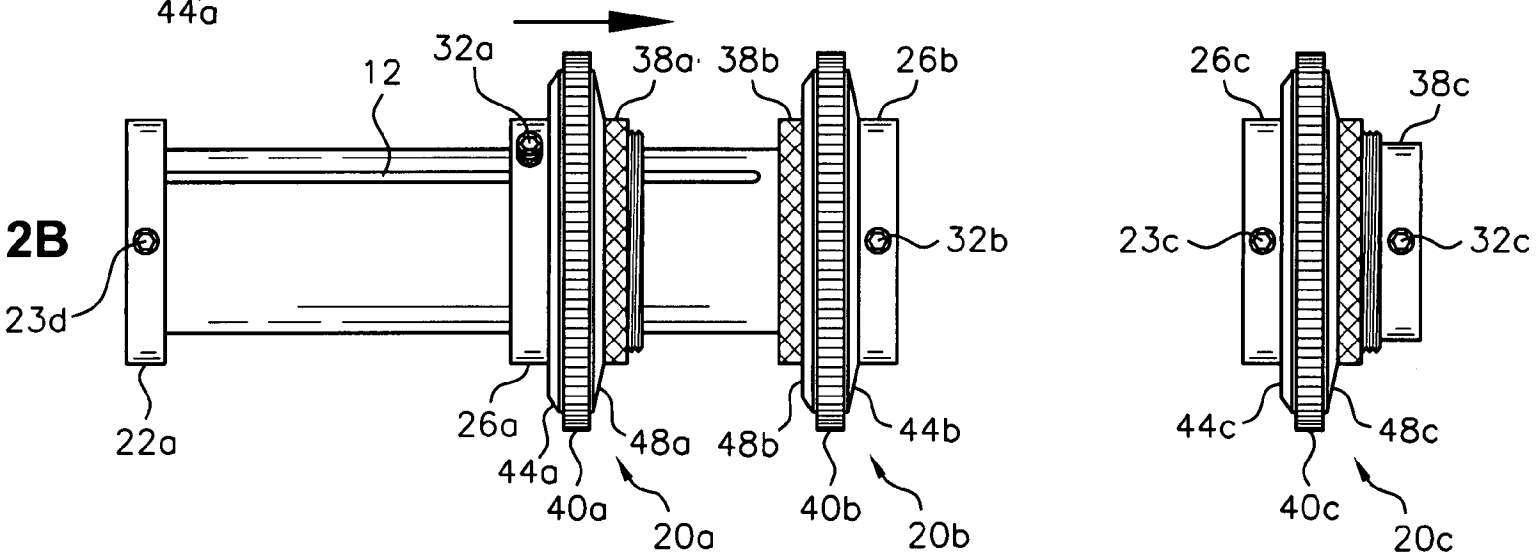
FIG. 2*b* is a similar side elevational view showing the left side wheel assembly slidably displaced on the tube.
Figures 2C, 2D:
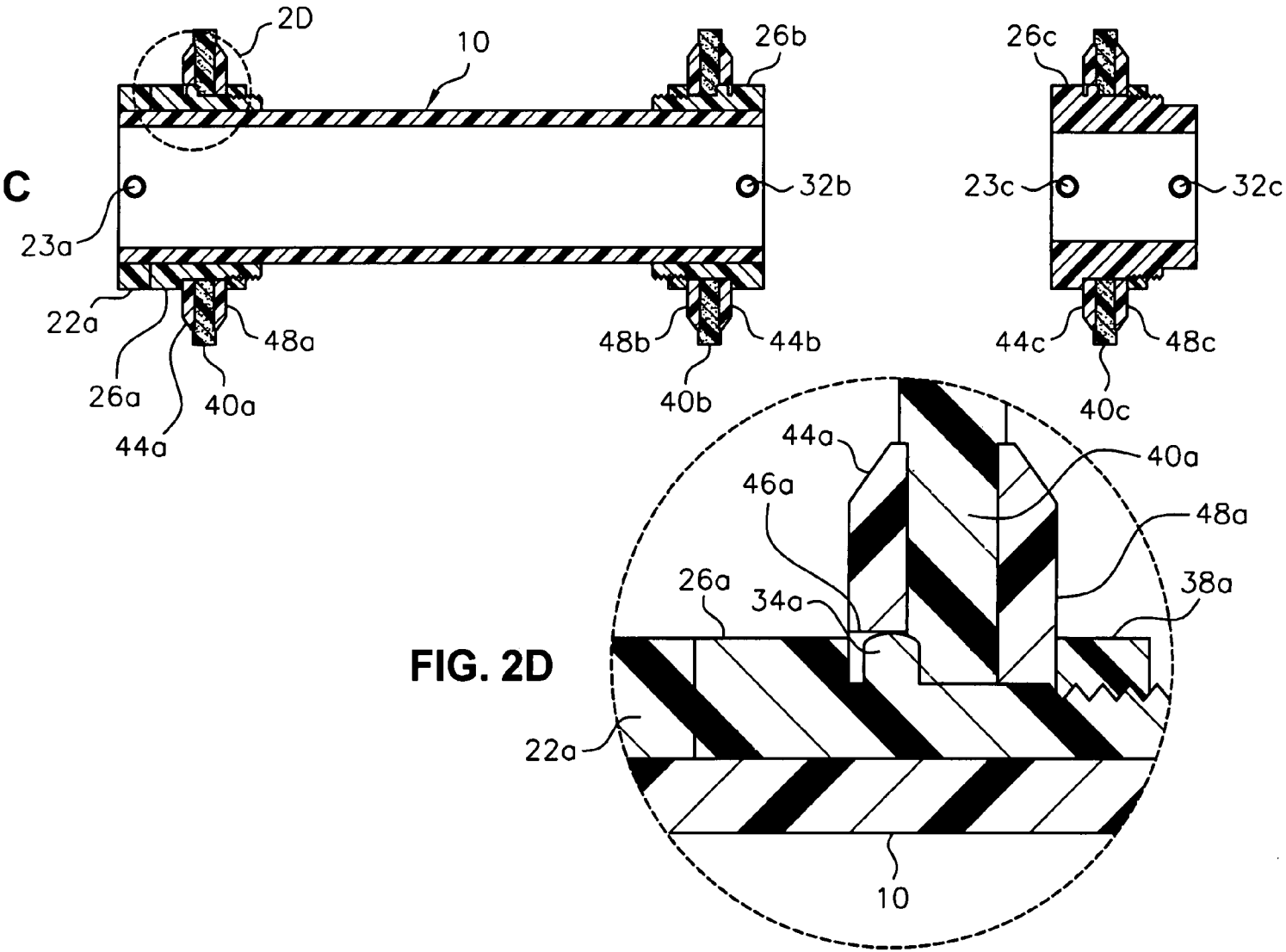
FIG. 2*c* is a transverse sectional through the slide tube and side wheel assemblies shown in FIG. 2*a;*
FIG. 2*d* is an enlarged fragmentary sectional view of the portion circled in FIG. 2*c* showing the left end side wheel assembly fully mounted on the slide tube with the alignment pin engaging in the keyway of thread wheel supporting.
Figure 3:
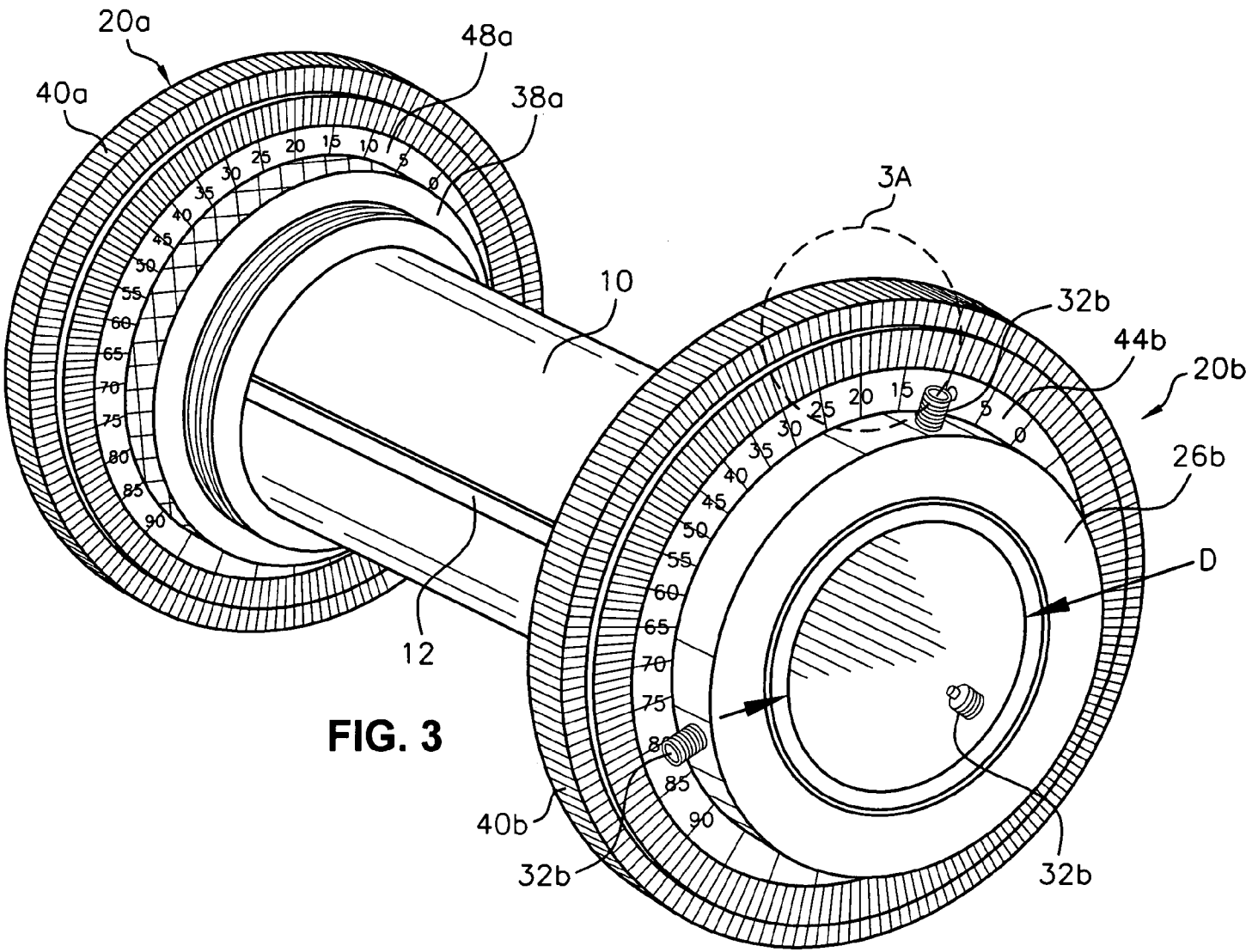
FIG. 3 is a perspective view of the tube with two of the side wheel assemblies mounted thereon.
Figure 3A:
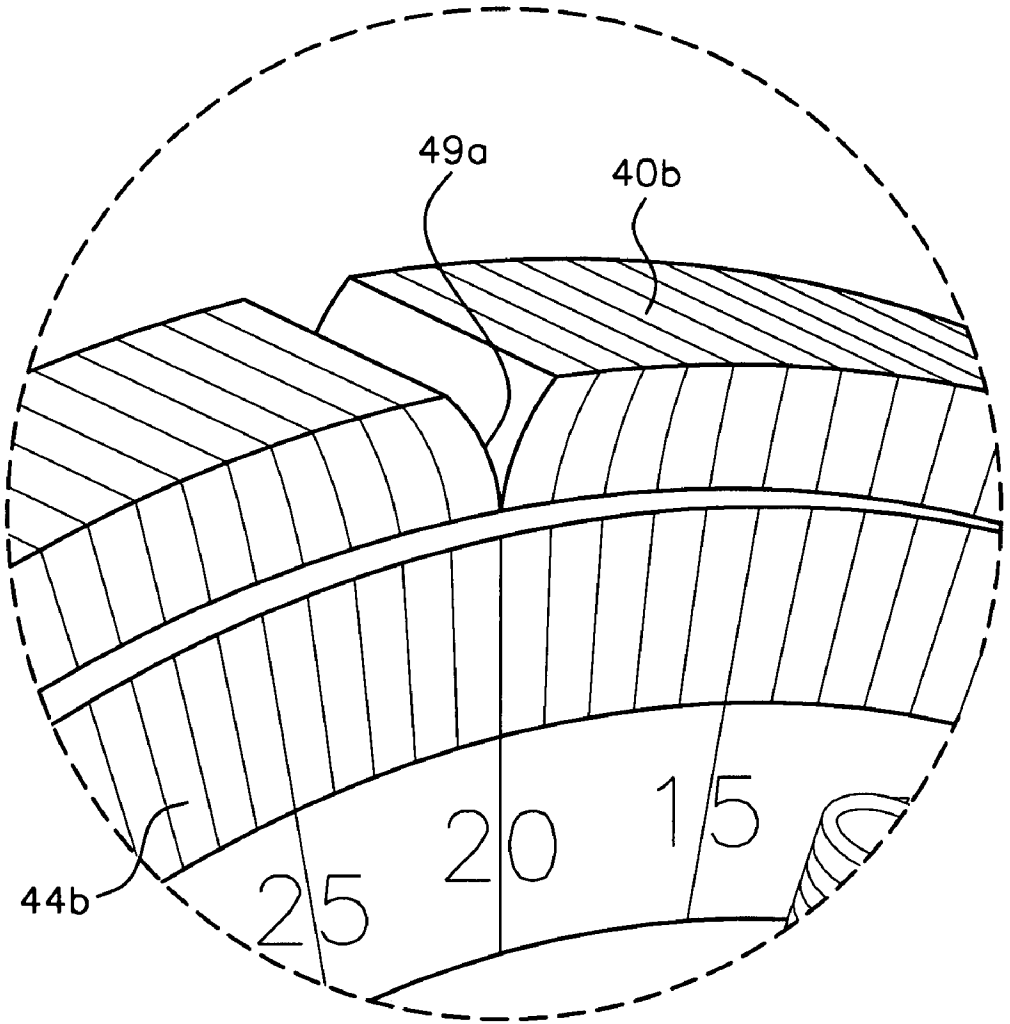
FIG. 3*a* is an enlarged fragmentary view of the portion circled in FIG. 3 showing the slits in the thread wheel for the threads to be woven.
Figure 4:
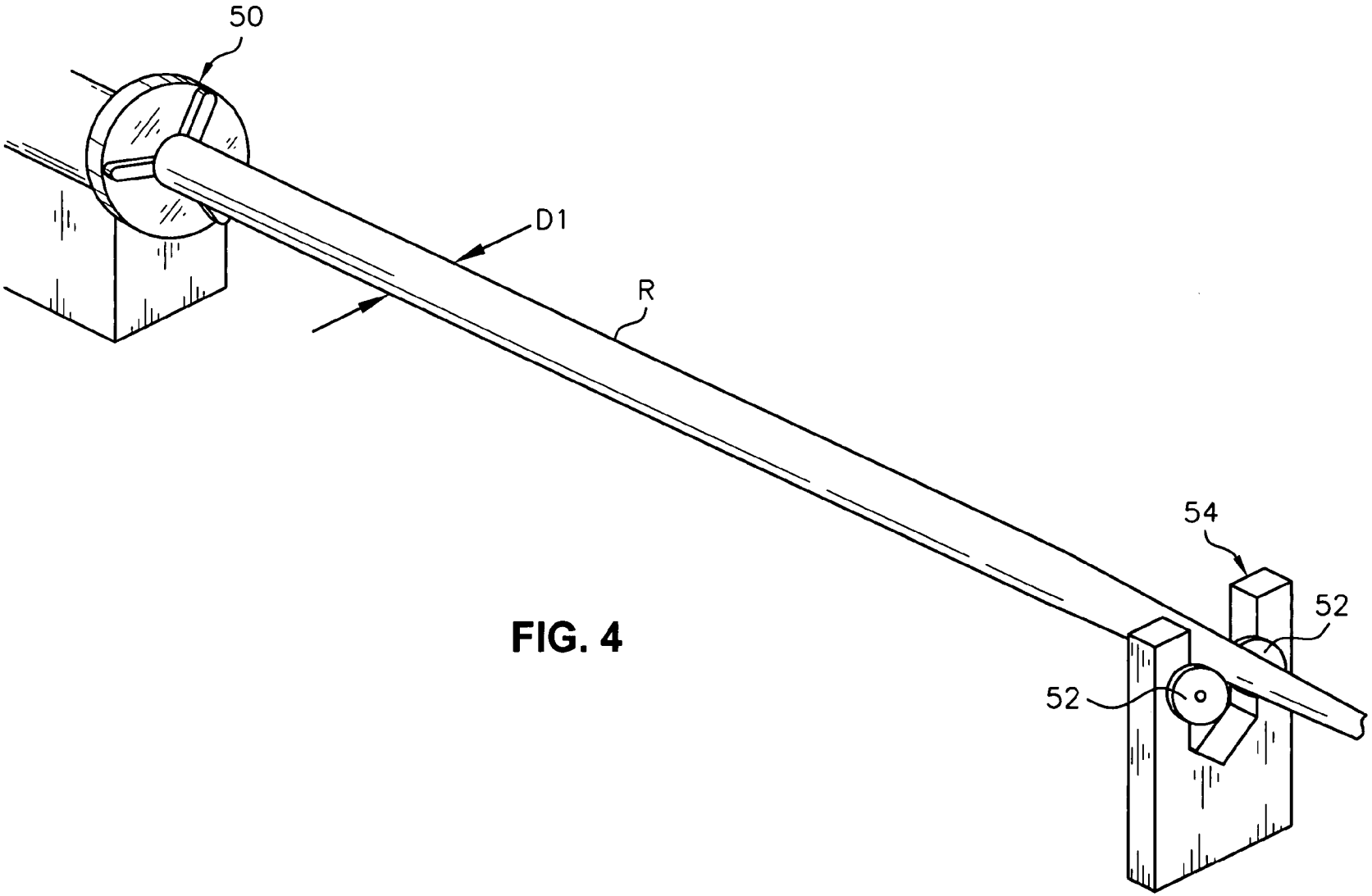
FIG. 4 is a perspective view of a chuck and support fixture for rotatably mounting a fishing rod during the weaving process.

Referring now to the drawings and particularly to FIGS. 1–3 thereof, there is shown apparatus in accordance with the present invention for weaving designs or patterns around a cylindrical object such as a fishing rod R. The apparatus is characterized by novel features of construction and arrangement facilitating a continuous, seamless weave around a fishing rod for the full 360° with a variety of patterns or designs ranging from a single continuous pattern around a full circumference of a rod to a split design wherein a fish pattern may be placed on one side of a rod and indicia such as the owners name or initials on the other side of the rod.

To this end, the apparatus comprises an elongated hollow slide tube (10) having an internal diameter (D) greater than the rod diameter (D1) to allow positioning of the tube (10) member on the rod in a manner to be described hereafter. As best illustrated in FIG. 1, the tube (10) has an axial groove (12) extending from the left hand end of the tube to a point short of the right hand axial end face and a series of radially directed tapped holes (14) for set screws to center the tube 10 relative to the rod R in a manner described in more detail hereafter. In the present instance there are three tapped holes adjacent each axial end of the tube (10) which are circumferentially equi-spaced as shown in FIG. 3.

The apparatus (10) further includes three side wheel assemblies generally designated by the numerals 20*a*, 20*b*, and 20*c*. The left hand side wheel assembly 20*a* is mounted for axial movement along the tube 10 and includes an end cap 22*a* having in the present instance, three (3) equi-spaced circumferentially and radially extending tapped holes 24*a*. The end cap 22*a* is positioned over the left hand end of the slide tube (10) so that the holes 14 and 24*a* are aligned. Set screws (23*a*) are then threaded into the aligned tapped holes to mount the end cap (22*a*) on the left hand end of the slide tube (10) after the assembly of the other components comprising the slide wheel assembly (20*a*) and may be adjusted in the manner described hereafter to center the tube (10) on the rod R.

Figures 15, 15A:
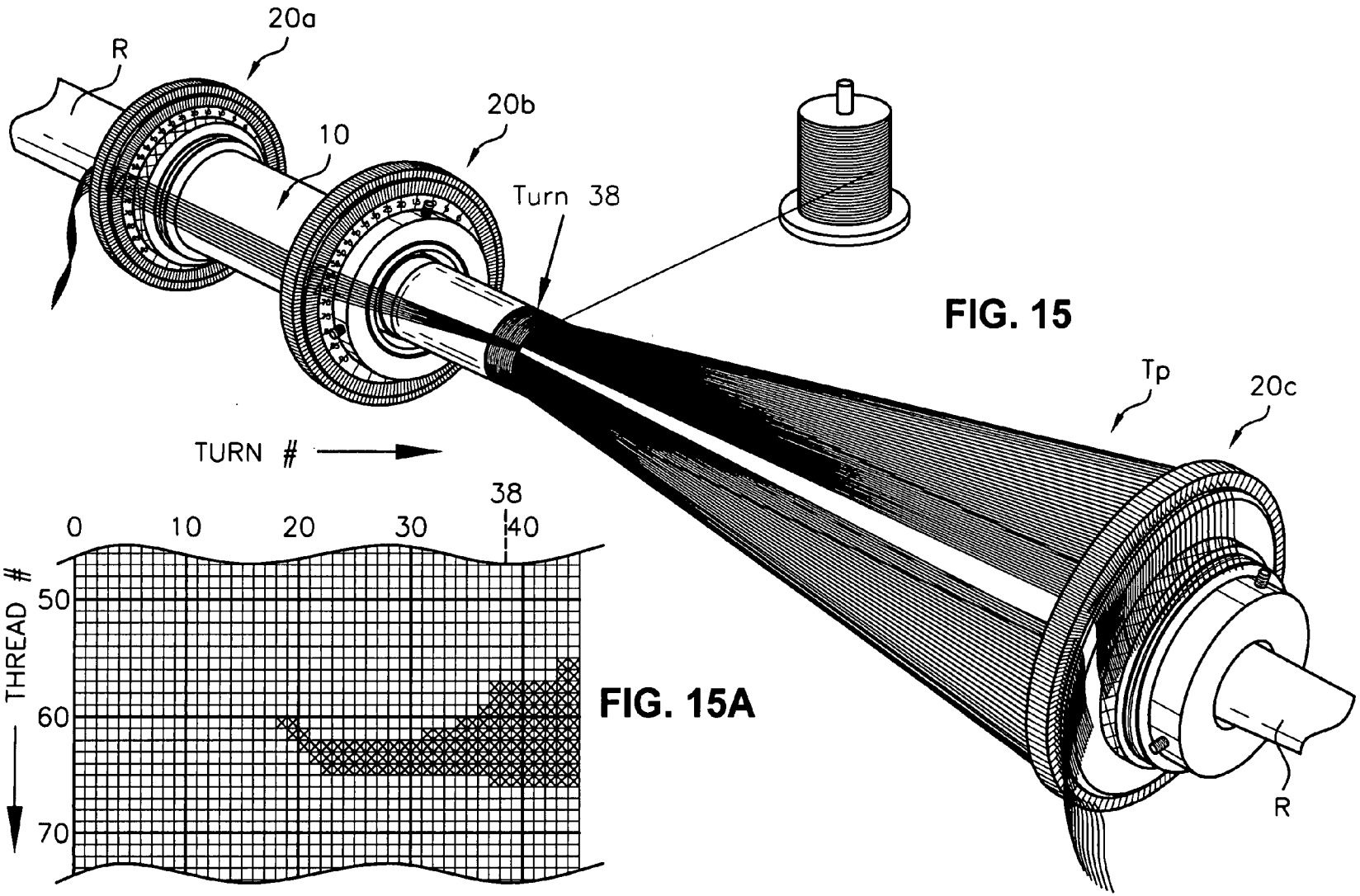
FIG. 15*a* is a fragmentary view of the pattern for turn 38 showing the pattern threads for rows 55–66 inclusive displaced as shown.
Figures 16, 16A, 16B:
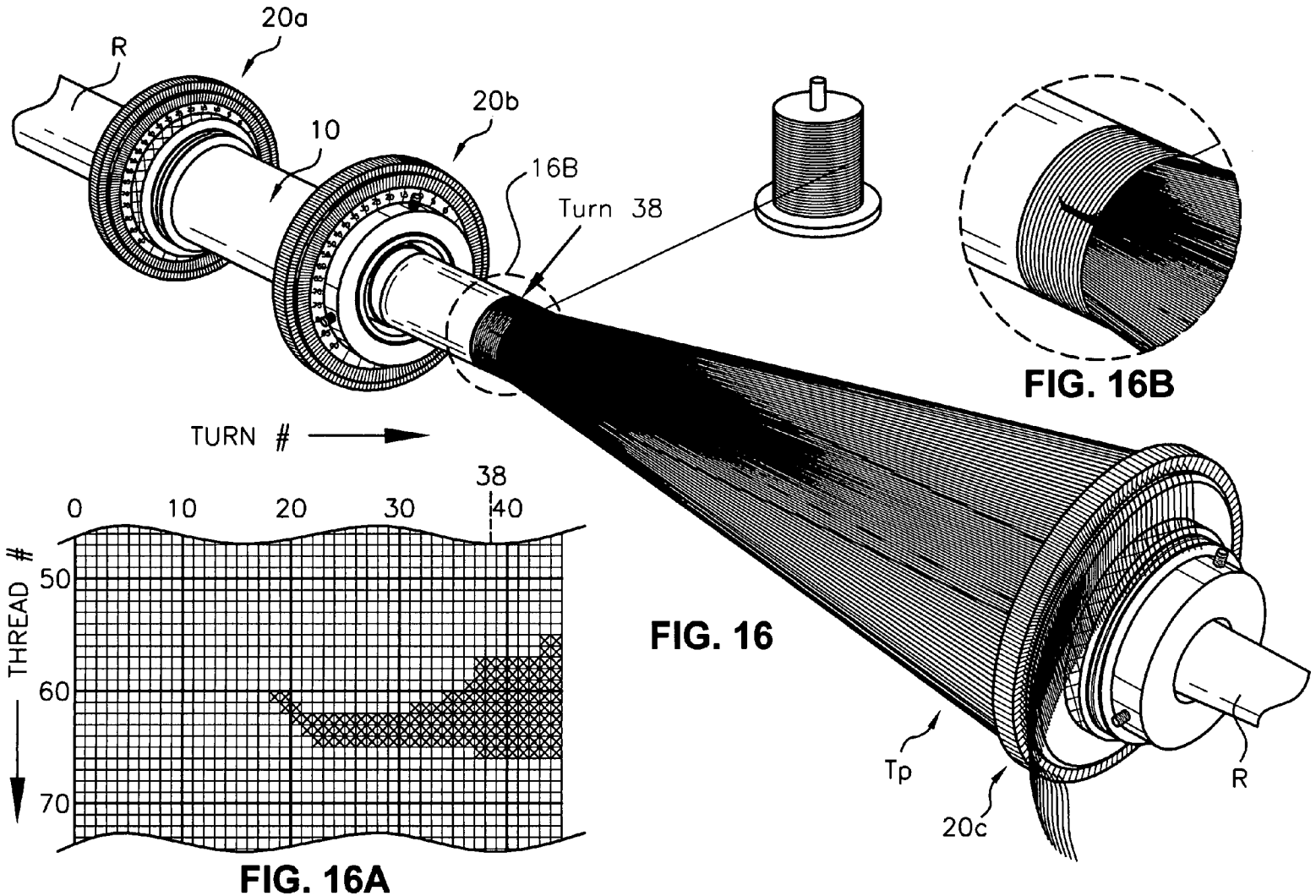
FIG. 16*a*. Is a fragmentary pattern view similar to FIG. 15*a*.
FIG. 16*b* is a fragmentary view of the portion circled in FIG. 16.

The left side wheel assembly (20*a*) includes a collar or slide head (26*a*) having an enlarged flange 28*a* at one axial end with a radial threaded opening for a dog nose set screw (32*a*) which rides in the axial groove (12) to permit sliding movement axially along the slide tube (10) and no rotation relative thereto. The side wheel assembly 20*a* may be releasably locked in a predetermined position on the slide tube 10 by simply threading the dog nose set screw 32*a* inwardly to maintain displaced pattern threads Tp taut as shown in FIG. 15 and thereby minimizing entanglement of pattern threads Tp. The slide head (26*a*) has a radially outwardly directed alignment pin (34*a*) and is threaded as at (36*a*) to mount a lock nut (38*a*) to secure the thread wheel (40*a*) and thread wheel support ring (44*a*) and number ring (48*a*) in place in the manner shown in FIG. 2*d*. The thread wheel (40*a*) is made from a flexible foam material and has a plurality of circumferentially spaced cuts or slots (49*a*) extending radially inwardly from its outer periphery for receiving the pattern threads Tp and is frictionally held in place on the alignment pin (34*a*) of the slide head (26*a*). A thread wheel support ring (44*a*) which is shown in FIG. 2*d* is keyed at (46*a*) to allow passage over the alignment pin (34*a*) when assembling the elements. A left hand number ring having number indicia for the slots (49*a*) which corresponds to the pattern thread lines in the pattern (see FIG. 10) with no key (48*a*) completes the assembly.

The components comprising the side wheel assemblies (20*b*) and (20*c*) are the same as the components comprising the side wheel assembly (20*a*) described above and accordingly like components have the same numerical designation and different subscripts b and c.

Figure 5:
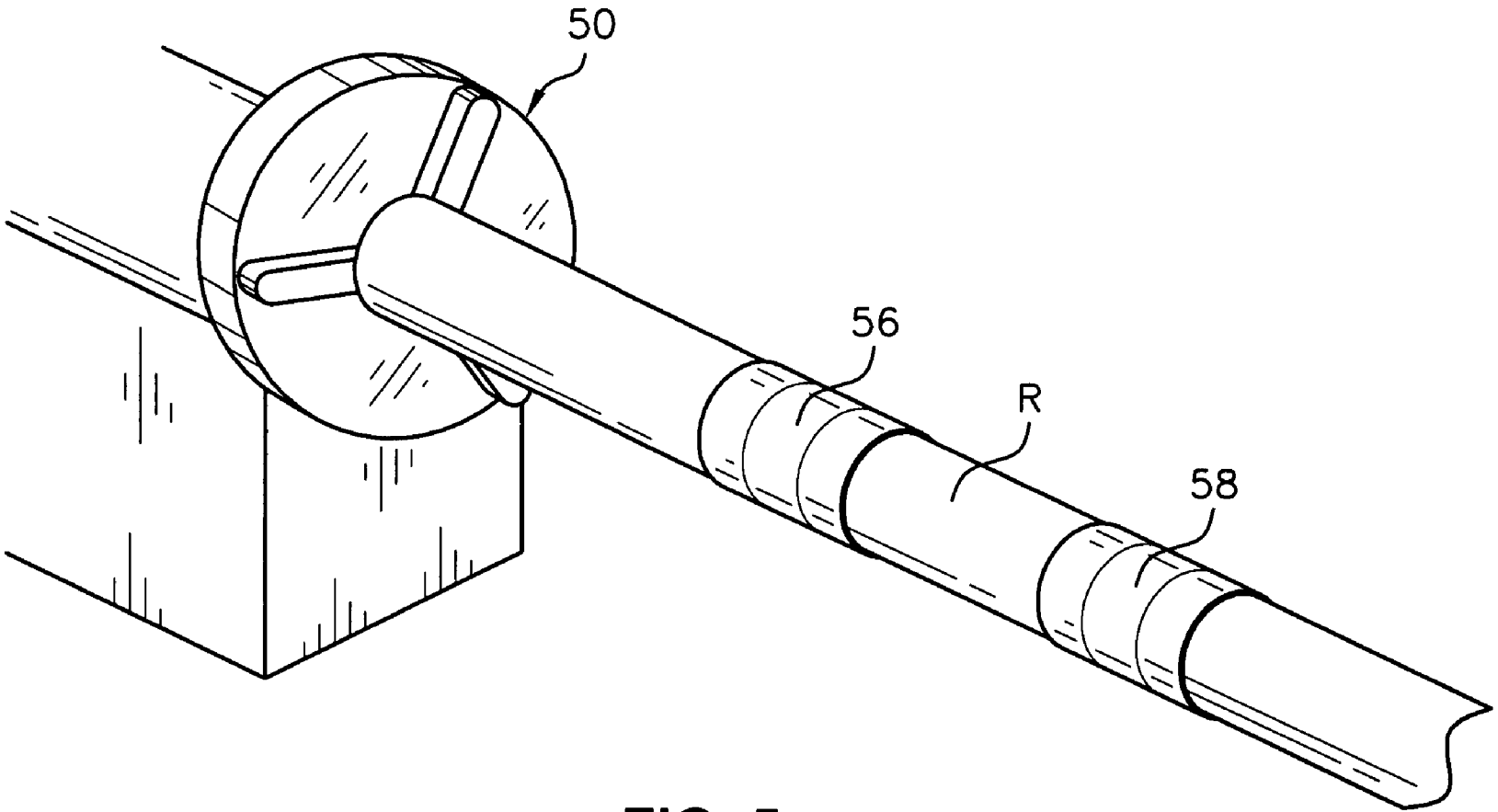
FIG. 5 is a fragmentary perspective view showing the first step in the preparation of the rod for the weaving method.
Figure 6:
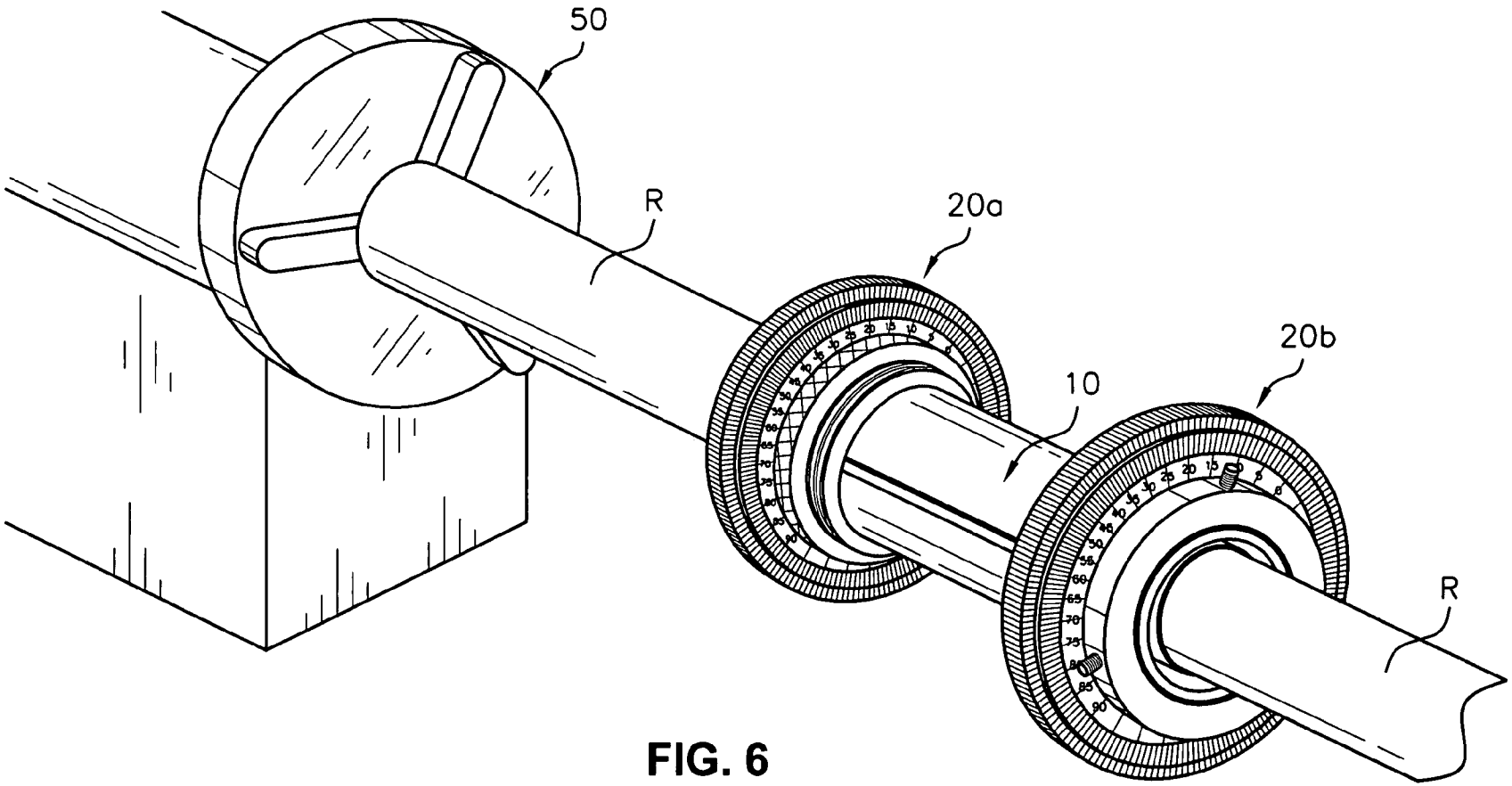
FIG. 6 is a fragmentary perspective view showing the weaving apparatus including the slide tube and two of the side wheel assemblies mounted on the slide tube circumscribing the fishing rod in the manner shown.
Figure 7:
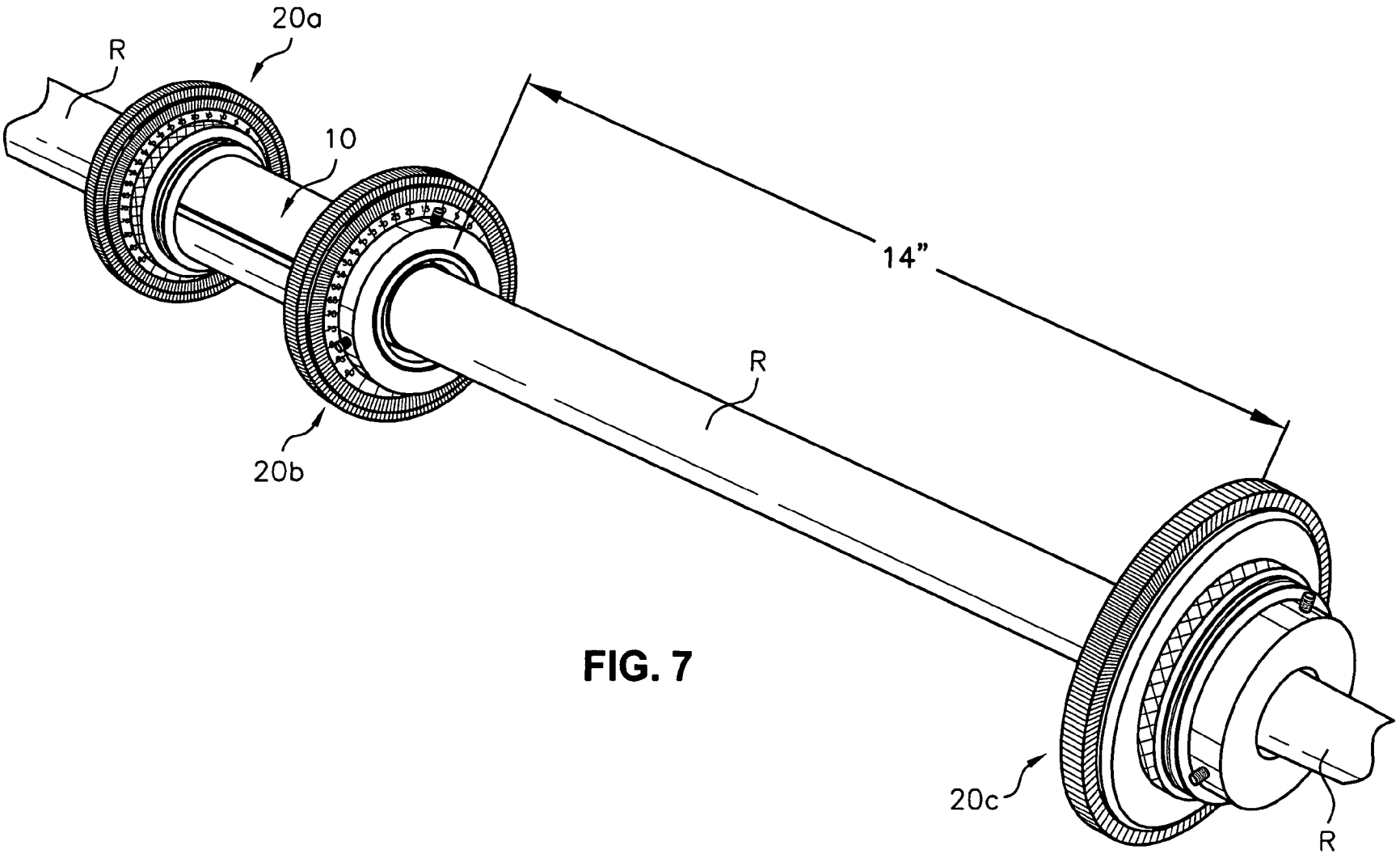
FIG. 7 is a fragmentary perspective view with the three side wheel assemblies in place.
Figure 8:
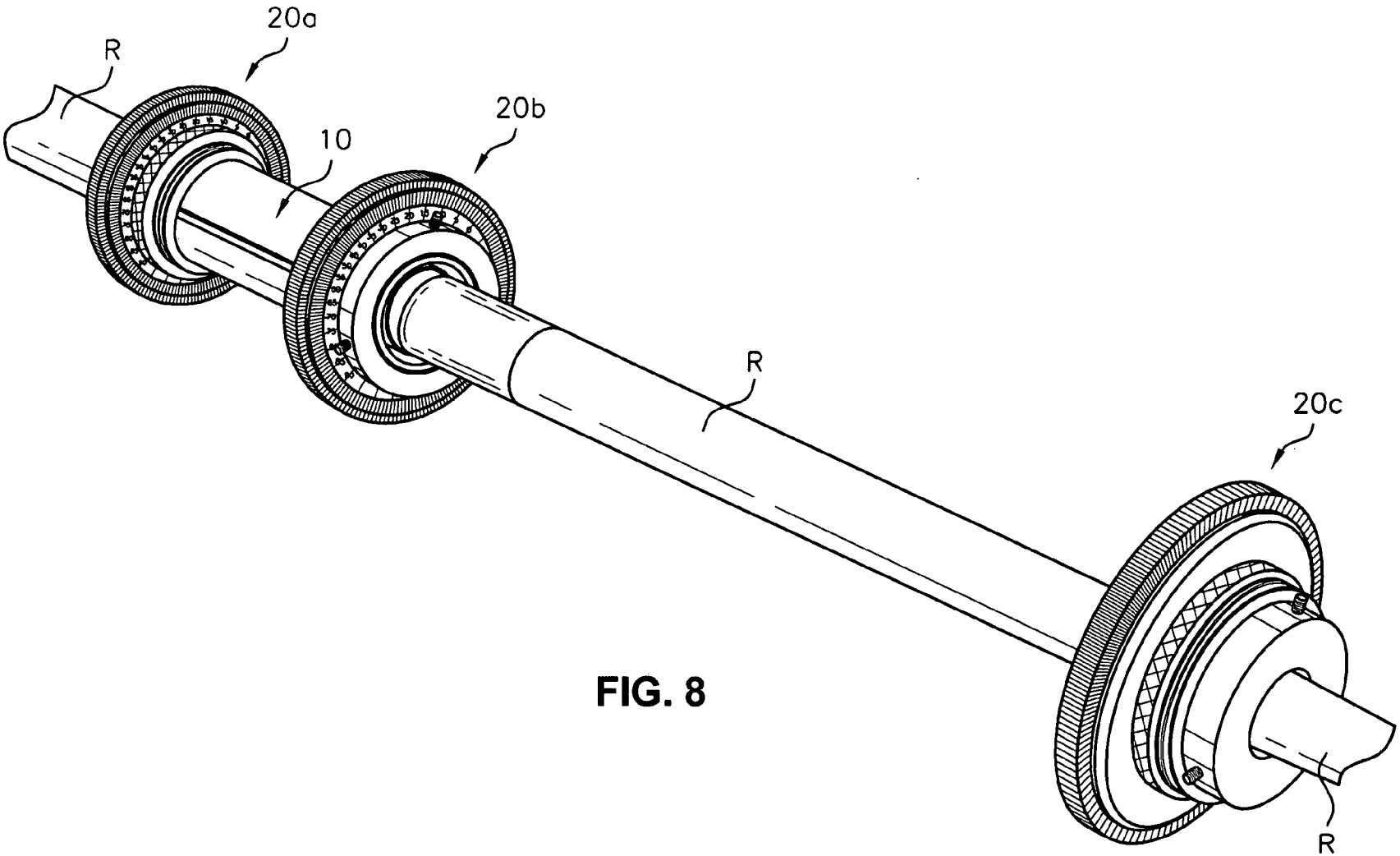
FIG. 8 is fragmentary perspective view showing another phase of setting up the apparatus for weaving a pattern on the fishing rod.
Figures 9, 9A:
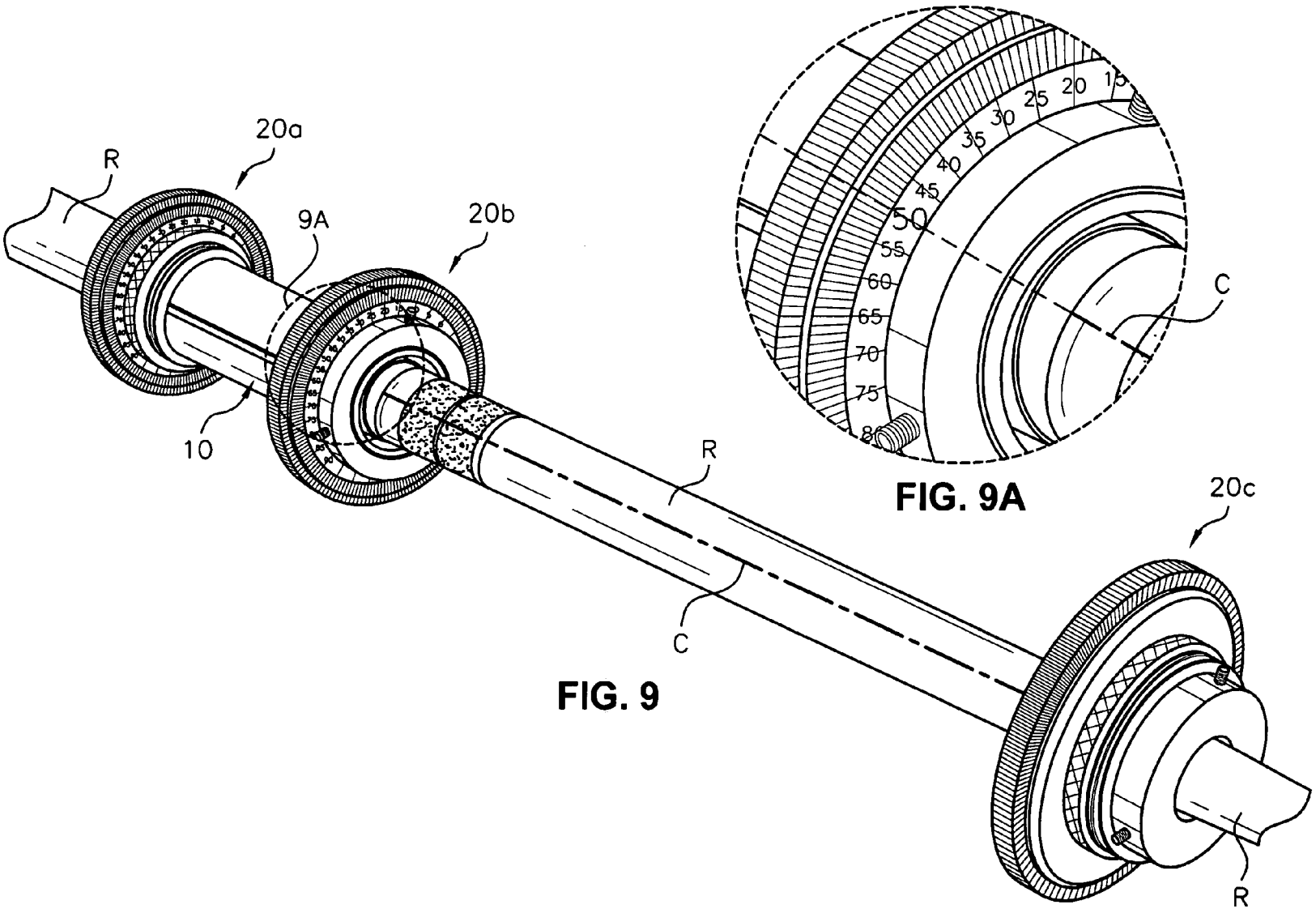
FIG. 9 is still another fragmentary perspective view showing the step of marking the center of the design or pattern when weaving a two stage pattern.
FIG. 9*a* is an enlarged fragmentary sectional view of the portion circled in FIG. 9 showing the elements of the middle side wheel assembly including the number ring and foam slotted thread wheel.
Figure 10:
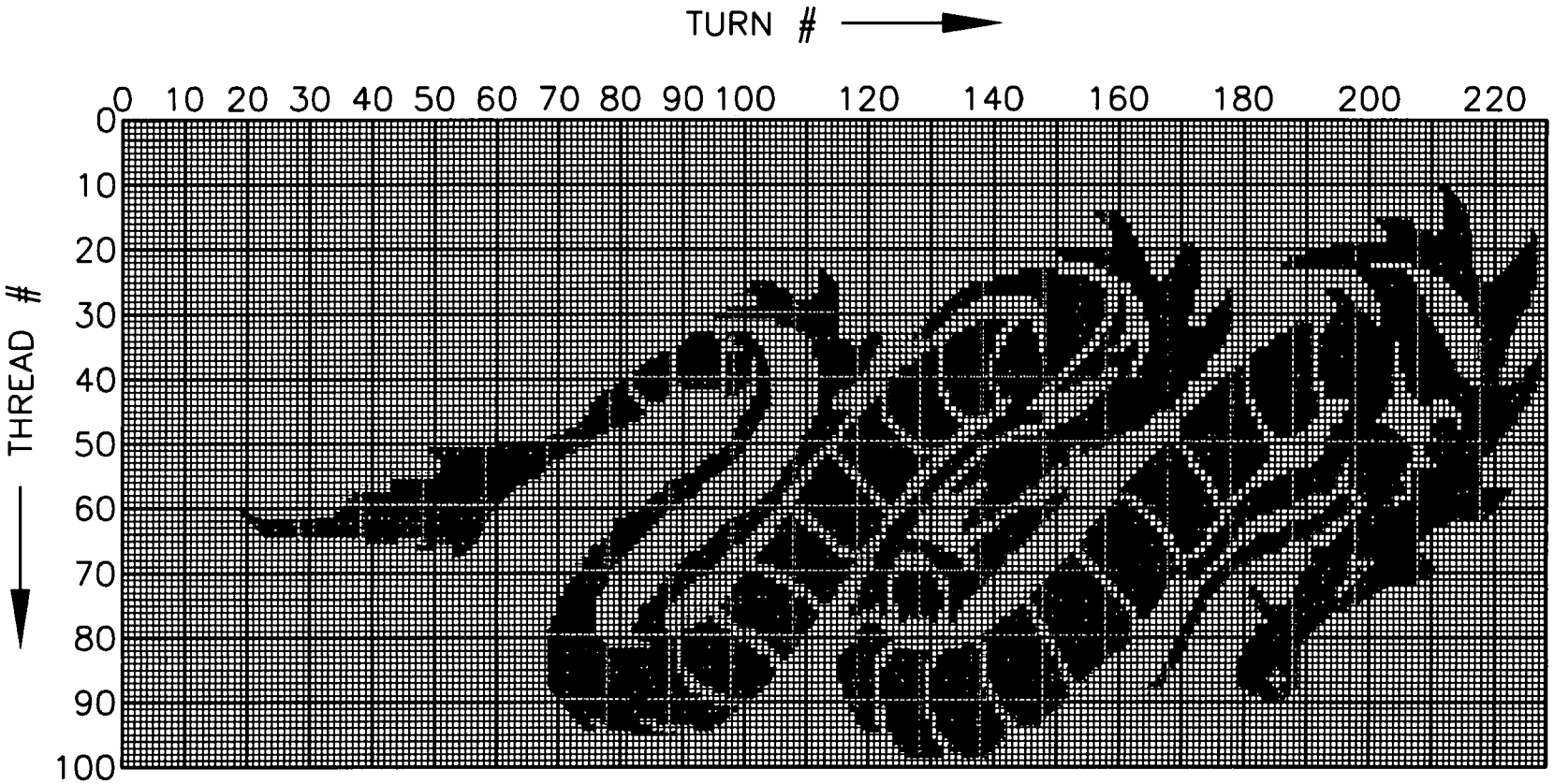
FIG. 10 is a plan view of a pattern to be woven.

Considering now the steps in setting up the apparatus of the present invention for a weaving operation and assuming that it is desired to weave the pattern shown in FIG. 10 on a fishing rod adjacent the butt end. Position the rod R in the chuck (50) with the tip end engaging the wheels (52) of support fixture (54). Lift the tip end and place the slide tube (10) near the butt end of the rod R downstream of where it is desired to locate the design or pattern to be woven on the rod. Mark these areas as noted previously. If these areas fall on a grip wrap, protect the grip wrap by a piece of cardboard tubing or the like and secure it in place with a piece of masking tape where the set screws will engage. These two taped areas are designated (56) and (58) in FIG. 5. Apply duct tape wrappings for the right side wheel (20*c*) which is positioned about 14 inches to the right of where you want the weave to start. As explained above, the number rings are numbered only half way around to allow for a second pattern when weaving more than one pattern at a time.

The next step is to mark the pattern center line on the rod R so that the three side wheel assemblies are aligned. As noted previously, the numbering on the number rings of the side wheel assemblies ascend in the same direction, the right and left side wheel assemblies (20*a*) and (20*b*) being mirror images of one another. The numbering will get higher to the right on the right side wheel assembly (20*c*) and higher to the left on the left side wheels (20*a*) and (20*b*) with the wheel lying flat on the table in front of you with the numbers facing up. Assemble the tube and mount it on the rod with the numbers facing to the right. Align the center pattern thread number with the pattern center line C on the rod. Then while holding the tube (10) centered, tighten the set screws until they are just snug enough to keep the tube (10) from moving.

Next, mount the right side wheel assembly (20*c*) with the number ring (48*c*) facing to the left and the center thread number (50) on the center line C. Hold it centered and snug and turn the screws to anchor it in place on the rod. The tube (10) and side wheel assemblies are now properly aligned in position for application of pattern threads Tp.

Figure 11:
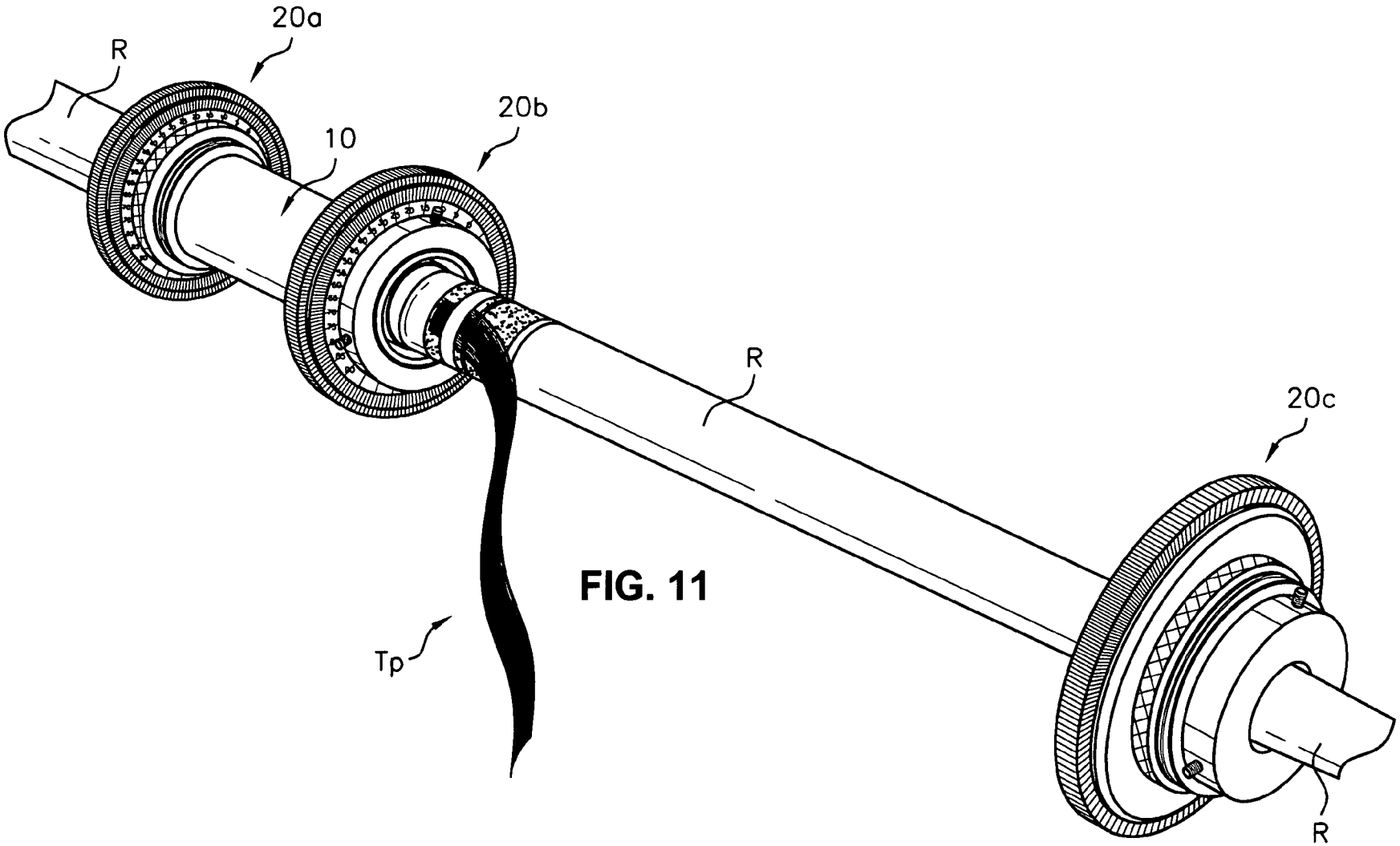
FIG. 11 is a fragmentary perspective view showing the initial step in positioning the pattern threads on the rod.
Figures 13, 13A:
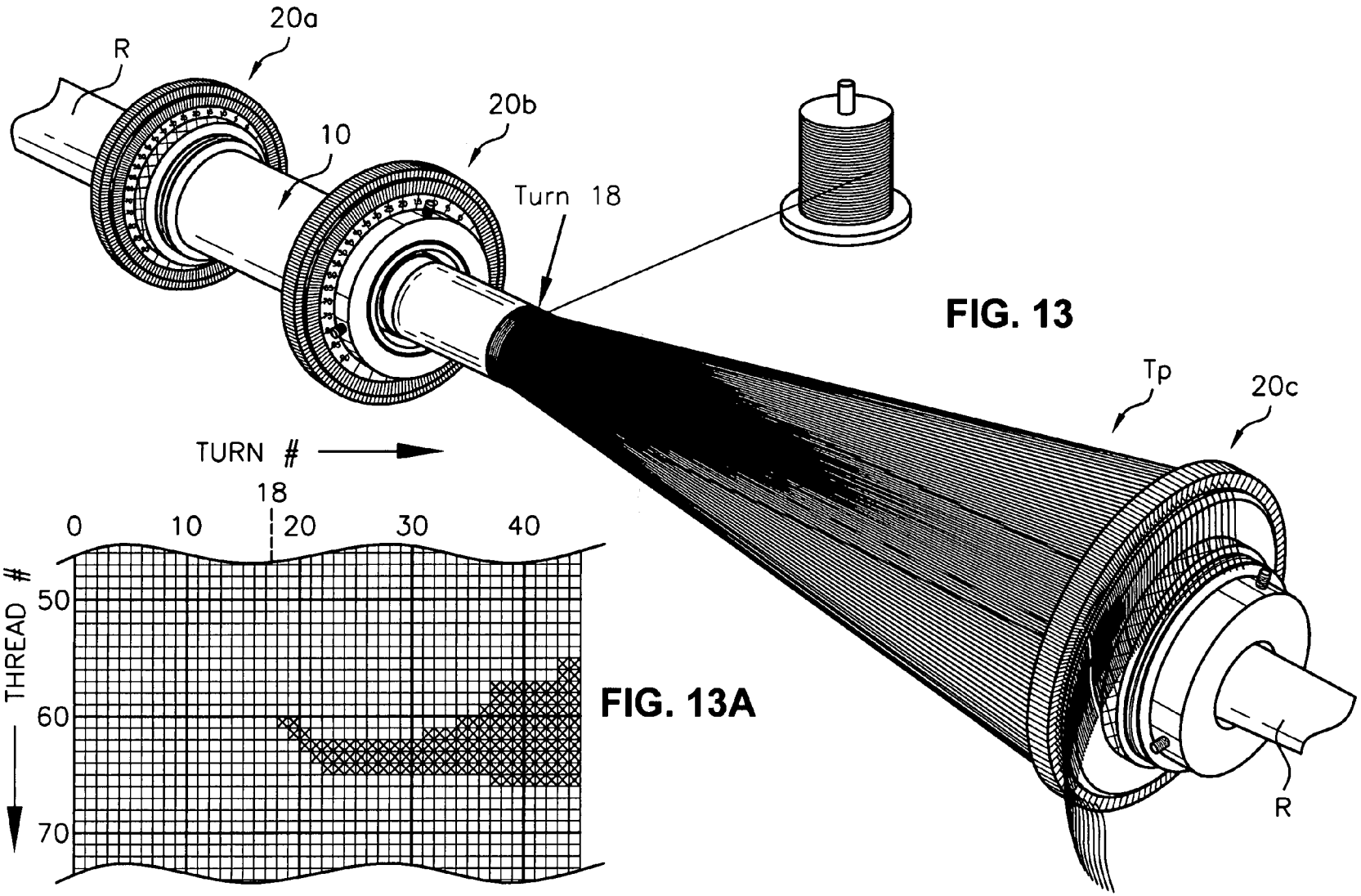
FIG. 13 is a fragmentary perspective view showing application of the background thread for the first eighteen (18) turns for the pattern shown in FIG. 10.
FIG. 13*a* is a fragmentary view of the pattern showing the wrapping thread overlying all the pattern threads for the dragon pattern for the first eighteen (18) turns.
Figures 14, 14A:
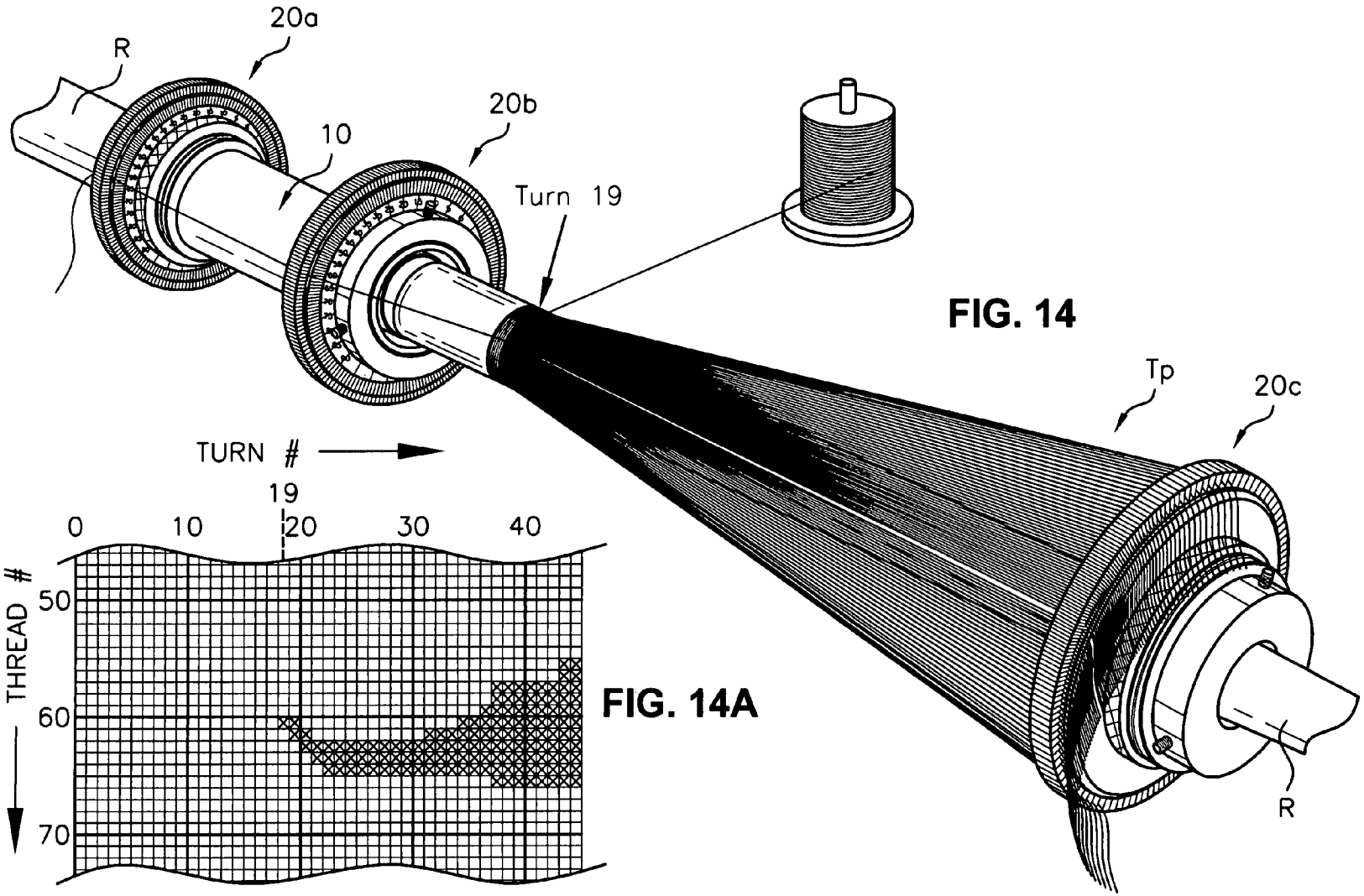
FIGS. 14–16 inclusive are fragmentary perspective views showing progress of the weaving through turn (38) of the pattern shown in FIG. 10.
FIG. 14*a* is a fragmentary view of the pattern with the single pattern thread displaced from right hand side wheel assembly to the left and center side wheel assemblies in corresponding slot sixty-one (61) so that the dragon pattern starts at turn nineteen (19)

The weaving apparatus is now ready for positioning the pattern threads Tp on the rod. Assume the dragon pattern has a single color in the design, namely, red that the background of the design or wrapping thread Tn is black. For example, if the red is the predominant thread, then the user must count in the pattern shown in FIG. 10 along the thread hairs the number of red threads in its pattern and if the total, for example is 89, 89 threads of approximately 16 inch in length are cut and secured to the rod in the manner shown in FIG. 11. The pattern threads can be secured by tape reversed on itself at the base so the sticky side is out. As noted previously, there should be enough between the tape and start of the weave to allow cutting the pattern threads loose when the weave is complete. The free end of each of the red pattern threads is then placed in the appropriate slot on the right side wheel assembly (20*c*). For example, as shown in FIG. 10, the red spans the pattern from the thread number (10) to thread number (98). Thus 88 threads should be inserted into the slots numbered (10) through (98) on the numbering (48*c*) of the right side wheel assembly (20*c*). When all of the pattern threads have been cut and assembled in this manner, the user can now commence the weave. Note that in the pattern the first eighteen (18) turns are all background and does not have any of the pattern threads showing and accordingly, the rod is rotated eighteen (18) turns to the positions shown in FIGS. 13 and 13*a*. Note the wrapping thread Tw overlies all the red pattern threads Tp for this portion of the weave. Turn (19) includes one row of the red pattern in thread #, row 61 of the pattern and accordingly, the red pattern thread in slot 61 of the number ring (48*c*) is removed and engaged in slot 61 of side wheel assemblies (20*a*) and (20*b*) as shown in FIGS. 14 and 14*a*. As the weave progresses, more red pattern threads are withdrawn from the corresponding slots in the right side wheel assembly (20*c*)

and inserted in the corresponding slots in the middle and left side wheel assembly (20*a*) and (20*b*) as shown in FIGS. 15 and 15*a*. The rod is turned one row and the process of transfer of pattern threads dictated by the pattern continues until the design is completed which in this instance is shown on the pattern requires 230 turns.

Figure 12:
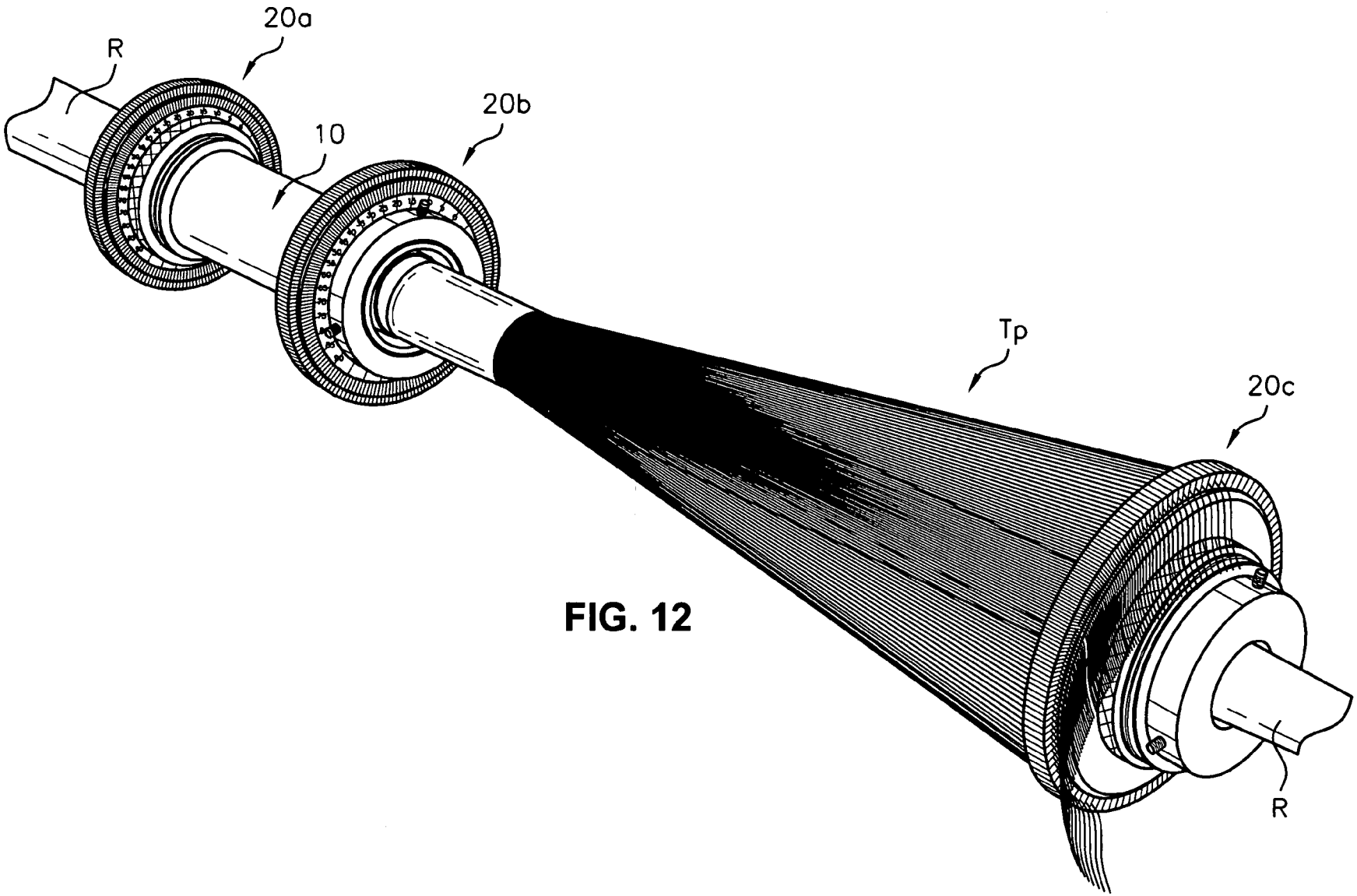
FIG. 12 is a fragmentary view showing all of the pattern threads in place in on the rod.

Even though the weaving process has been described with a pattern having only one color pattern thread red, it is to be understood that the method can be carried out with patterns having many colors. The steps would be essentially as described and the apparatus prepared in much the same way. The various color pattern threads Tp are applied to the rod initially in the manner shown in FIG. 11 and usually the color appearing in the greatest number of rows is applied first and other colors are secured around the circumference of the rod and positioned in the appropriate slots (49*c*) of the side wheel assembly (20*c*) as shown in FIG. 12. If two or more colors are in a single row of the thread # rows (see FIG. 10), they are loaded to the same numbered slot (49*c*) and transferred to the similarly numbered slots (49*a*) and (49*b*) of the side wheel assemblies when the pattern calls for such a transfer.

Even though a particular embodiment has been illustrated and described herein, it is not intended to limit the invention and changes and modifications made therein within the scope of the following claims:

I hereby claim:

1. An apparatus for weaving patterns comprising pattern threads and wrapping threads around an object having a central axis comprising an elongated slide tube and at least two side wheel assemblies, one of said side wheel assemblies mounted on said slide tube and the other of said side wheel assembly mounted on said object and spaced axially therefrom a distance greater than the axial extent of the pattern to be weaved; each of said side wheel assemblies having a thread wheel with a series of radially directed circumferentially spaced slots and a number ring having number indicia means which are axially aligned relative to one another and which correspond to pattern thread lines on a chart for a pattern; means for securing the pattern threads at one end to said object and engaging each of the threads in a numbered slot in one of the side wheel assemblies which may be selectively withdrawn from the slot in said one side wheel assembly and inserted into a corresponding number in said other side wheel assembly during the weaving process.

2. Apparatus as claimed in claim 1 including a third side wheel assembly for selective axial movement to maintain a pattern threads taut when mounted in the number ring of the slidable third side wheel assembly.

3. Apparatus as claimed in claim 1 wherein said number rings are made of a flexible foam material so that the slots can be opened readily for insertion of pattern threads.

4. A method of weaving around a cylindrical object, a design or pattern comprising pattern threads and a wrapping or background thread comprising the steps of;

securing pattern threads at one end to the object and placing the free end of the pattern threads in numbered slots of a side wheel assembly encircling the object;

moving selected ones of said pattern threads from the slots of the first side wheel assembly to a second side wheel assembly located downstream of the point where the pattern threads are secured to the object and positioning the displaced threads in correspondingly numbered slots of the second side wheel assembly whereby pattern threads may be selectively positioned in or out of the path of the background thread when the object is rotated during the weaving cycle.

5. An apparatus for weaving patterns around an object comprising pattern threads and wrapping threads comprising an elongated slide tube and at least two side wheel assemblies, one of said side wheel assemblies mounted on said slide tube and the other of said side wheel assemblies mounted on the object, each of said side wheel assemblies having a thread wheel with a series of spaced slots and a number ring having number indicia means cooresponding to pattern thread lines on a chart for a pattern; means for securing the pattern threads at one end to the object and engaging each of the threads in a numbered slot in one of the side wheel assemblies which may be selectively withdrawn from the slot in said one side wheel assembly and inserted into a corresponding number in said other side wheel assembly during the weaving process.

* * * * *